US006185848B1

(12) United States Patent
Chmiel

(10) Patent No.: US 6,185,848 B1
(45) Date of Patent: Feb. 13, 2001

(54) PROOF-OF-ENTRY DEVICE AND BADGE SUITABLE IN PARTICULAR FOR SUCH A DEVICE

(75) Inventor: Jehoshua Chmiel, München (DE)

(73) Assignee: WAW World Art Watch Vertriebs GmbH, Munich (DE)

( * ) Notice: Under 35 U.S.C. 154(b), the term of this patent shall be extended for 0 days.

(21) Appl. No.: 08/809,285

(22) PCT Filed: Sep. 8, 1995

(86) PCT No.: PCT/EP95/03543

§ 371 Date: May 6, 1997

§ 102(e) Date: May 6, 1997

(87) PCT Pub. No.: WO96/08000

PCT Pub. Date: Mar. 14, 1996

(30) Foreign Application Priority Data

Sep. 9, 1994 (DE) ..... 44 32 171
Jan. 16, 1995 (DE) ..... 195 01 075

(51) Int. Cl.[7] ..... A44C 3/00
(52) U.S. Cl. ..... 40/1.5; 40/661.04; 283/105
(58) Field of Search ..... 40/1.5, 647, 652, 40/654.01, 658, 661.04, 661.06, 661.08, 666; 16/225; 24/3.1, 3.11, 3.12, 3.5, 3.7, 3.8, 3.9, 304, 327, 454, 703.1; 283/100, 103, 105

(56) References Cited

U.S. PATENT DOCUMENTS 1,054,192 * 2/1913 Geddes ..... 40/661.08 X
1,438,433 * 12/1922 Faith ..... 40/661.06 X (List continued on next page.)

FOREIGN PATENT DOCUMENTS 865 516 2/1953 (DE) .
15 36 709 B2 1/1970 (DE) .
7025477 4/1971 (DE) .
1 774 064 10/1971 (DE) .
2 220 075 11/1973 (DE) .
28 03 426 A1 9/1978 (DE) .
84 36 941 U 5/1985 (DE) .
35 38 685 C2 8/1987 (DE) .
89 01 912 U 7/1989 (DE) .
93 03 264 U 7/1993 (DE) .
93 15 792 U 2/1994 (DE) .
94 00 704 U 5/1994 (DE) .
43 02 170 A1 7/1994 (DE) .
41-4679 3/1941 (JP) .
54-66800 5/1979 (JP) .
63-120281 8/1988 (JP) .
4-126269 11/1992 (JP) .

OTHER PUBLICATIONS

Copy of examiner's badge, Sep. 1988 (attached to action).*

*Primary Examiner*—Joanne Silbermann
(74) *Attorney, Agent, or Firm*—Westman, Champlin & Kelly, P.A.

(57) ABSTRACT

The present invention relates to a proof-of-entry device and a badge which is suitable in particular for a proof-of-entry device. The proof-of-entry device substantially comprises a badge and a validation component which, in a particularly preferable manner, are integral. Advantageously, the validation component is detachably secured on the badge. This component is preferably as wide and/or long as the badge and carries, for example, a chip, magnetic strip, bar code and/or a holographic image. The inventive badge, which is in particular suitable for a proof-of-entry device of this type, has a design support, a counter-member, a hinge connecting the design support and the counter-member, and a retaining element which, when the counter-member has been folded behind the design support, substantially secures these components.

16 Claims, 7 Drawing Sheets

U.S. PATENT DOCUMENTS

Figure 1:
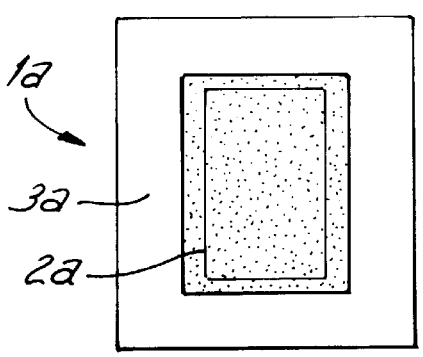

| | | | | |
|---|---|---|---|---|
| 1,481,173 | * | 1/1924 | Wright | 40/652 X |
| 1,567,315 | * | 12/1925 | Zaremba | 24/3.1 |
| 1,593,192 | * | 7/1926 | Respess et al. | 283/105 |
| 1,895,704 | * | 1/1933 | Crosby | 40/661.04 |
| 2,121,203 | * | 6/1938 | Knoble | 283/105 |
| 2,226,969 | * | 12/1940 | D'Onofrio | 24/3.5 |
| 2,675,636 | * | 4/1954 | Schulz | 40/647 |
| 3,280,488 | * | 10/1966 | Rubin | 40/1.5 |
| 3,326,268 | * | 6/1967 | Dixon | 16/225 X |
| 3,355,826 | * | 12/1967 | Klein et al. | 40/1.5 |
| 3,381,398 | * | 5/1968 | Yow-Jiun Hu | 40/654.01 |
| 3,488,812 | * | 1/1970 | Gaydos | 24/3.12 |
| 3,670,358 | * | 6/1972 | Schwartz et al. | 16/225 |
| 3,930,673 | * | 1/1976 | Sanden | 283/105 |
| 4,097,971 | * | 7/1978 | Morris | 40/658 X |
| 4,154,362 | * | 5/1979 | McKenney | 16/225 X |
| 4,438,605 | * | 3/1984 | DeLucia | 16/225 X |
| 4,536,924 | | 8/1985 | Willoughby . | |
| 4,705,301 | * | 11/1987 | Dojel | 283/105 |
| 4,779,120 | | 10/1988 | Haas . | |
| 4,780,934 | * | 11/1988 | Vickers et al. | 24/3.11 |
| 4,881,150 | * | 11/1989 | Oyamada | 24/3.11 X |
| 4,980,679 | | 12/1990 | Klaubert . | |
| 5,191,682 | * | 3/1993 | Davis-Reardon et al. | 24/304 X |
| 5,261,583 | * | 11/1993 | Long et al. | 24/3.7 X |
| 5,313,721 | * | 5/1994 | Filden | 40/666 X |
| 5,364,132 | * | 11/1994 | Haas et al. | 40/1.5 X |
| 5,423,139 | * | 6/1995 | Feldman | 283/105 X |
| 5,524,327 | * | 6/1996 | Mickel et al. | 24/703.1 X |
| 5,640,742 | * | 6/1997 | White et al. | 24/327 X |

* cited by examiner

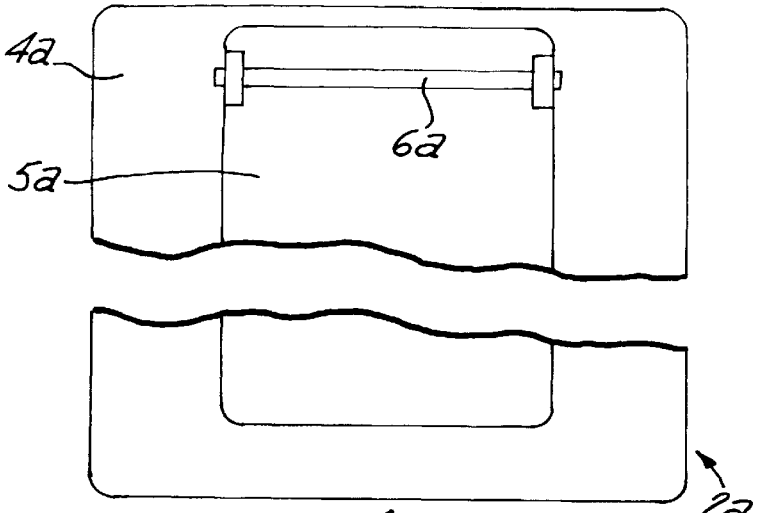
Fig. 7
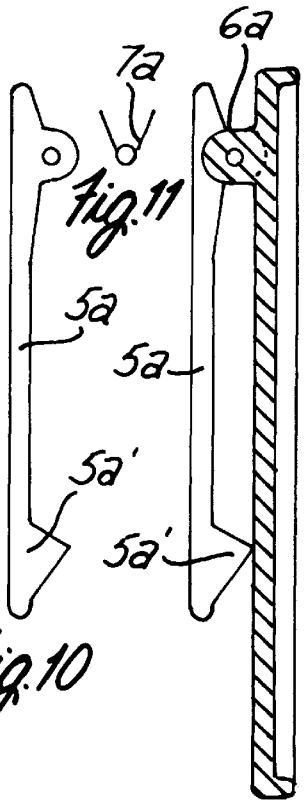
Fig. 11
Fig. 10
Fig. 9
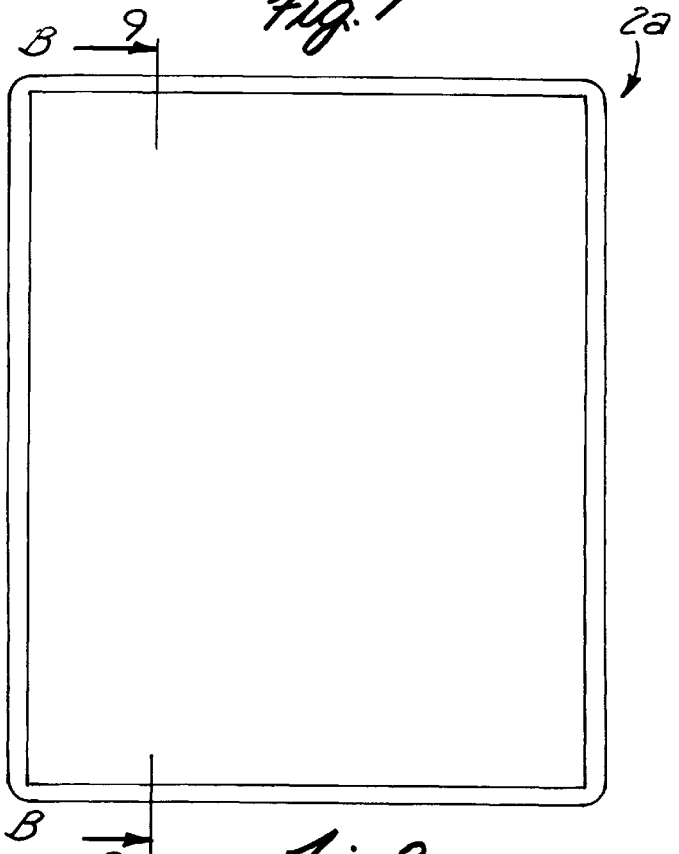
Fig. 8

PROOF-OF-ENTRY DEVICE AND BADGE SUITABLE IN PARTICULAR FOR SUCH A DEVICE

The present invention relates to a proof-of-entry device comprising a basic component and an invalidation component. Furthermore, the invention relates to a badge which is suitable in particular for a proof-of-entry device.

Proof-of-entry devices, such as tickets, are known comprising a basic component and an invalidation component which are purchased together. For invalidating the proof-of entry device, the invalidation component is removed from the basic component. In particular in the case of exhibits and the like, basic components have increasingly been designed more elaborately so as to function as a souvenir for the purchaser of the proof-of-entry device. For instance, basic components have been designed as postcards. Such basic components of proof-of-entry devices are increasing popular and are even traded as collectors' items.

It is the object of the present invention to provide a proof-of-entry device which can be invalidated wherein the proof-of-entry devices comprise a relatively high quality basic component which can easily be displayed.

This object is achieved by a proof-of-entry device with the features of the corresponding patent claims.

Furthermore, it is an object of the present invention to provide a badge which is easy to manufacture, space-saving and easy to fasten and which is suitable particularly for the proof-of-entry device according to the present invention.

This object is achieved by a badge with the features of the corresponding patent claims.

It is the gist of the present invention to provide a proof-of-entry device with a badge as a basic component and an invalidation component attached thereto which can preferably be peeled off the badge. In a preferred embodiment, the invalidation component optically supplements the badge, for instance if the invalidation component is provided in the form of a passe-partout and/or frame or a part thereof for a design on the badge.

Preferably, the badge and the invalidation component of the present invention are integrally formed, e.g. from a suitable plastic material, metal or cardboard.

Furthermore, the invalidation component preferably carries a chip, magnetic strip, a holographic image and/or a bar code for invalidation. Such elements can be invalidated automatically by means of suitable reading devices. Preferably, the invalidation component can be removed from the badge so that it may separately be introduced into a reading device and retained therein or invalidated. In the case of components which can be invalidated more than once, such as chips or magnetic strips, the invalidation components remain attached to the badge or can be re-attached thereto.

A badge according to the present invention, which is suitable in particular for the proof-of-entry device of the present invention comprises a design support and a counter member which are straight and which are folded together when the badge is used in order to form a clasp. They are secured in the folded position by means of a retaining element.

In the following the objects, advantages and features of the present invention are described in more detail by means of examples and with respect to the drawings.

Figure 2:
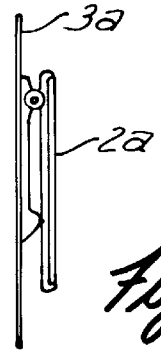
Figure 3:
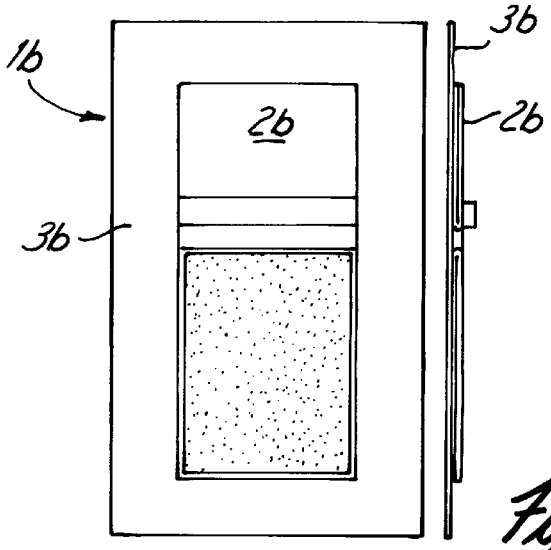
Figure 4:
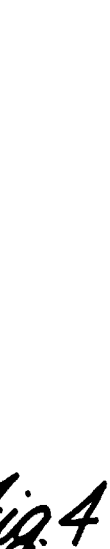
Figure 5:
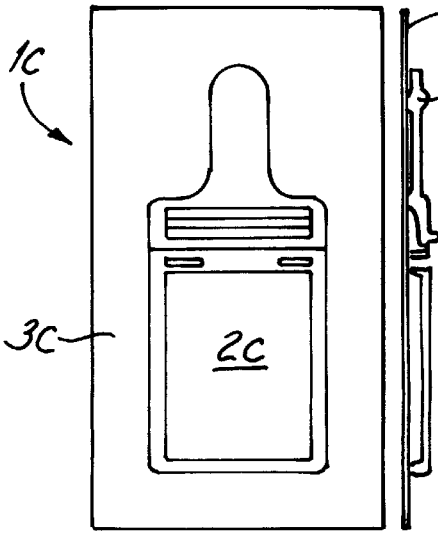
Figure 6:
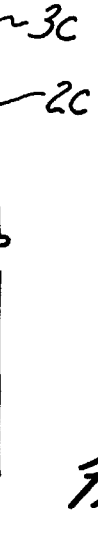
Figures 12, 13, 14, 15:
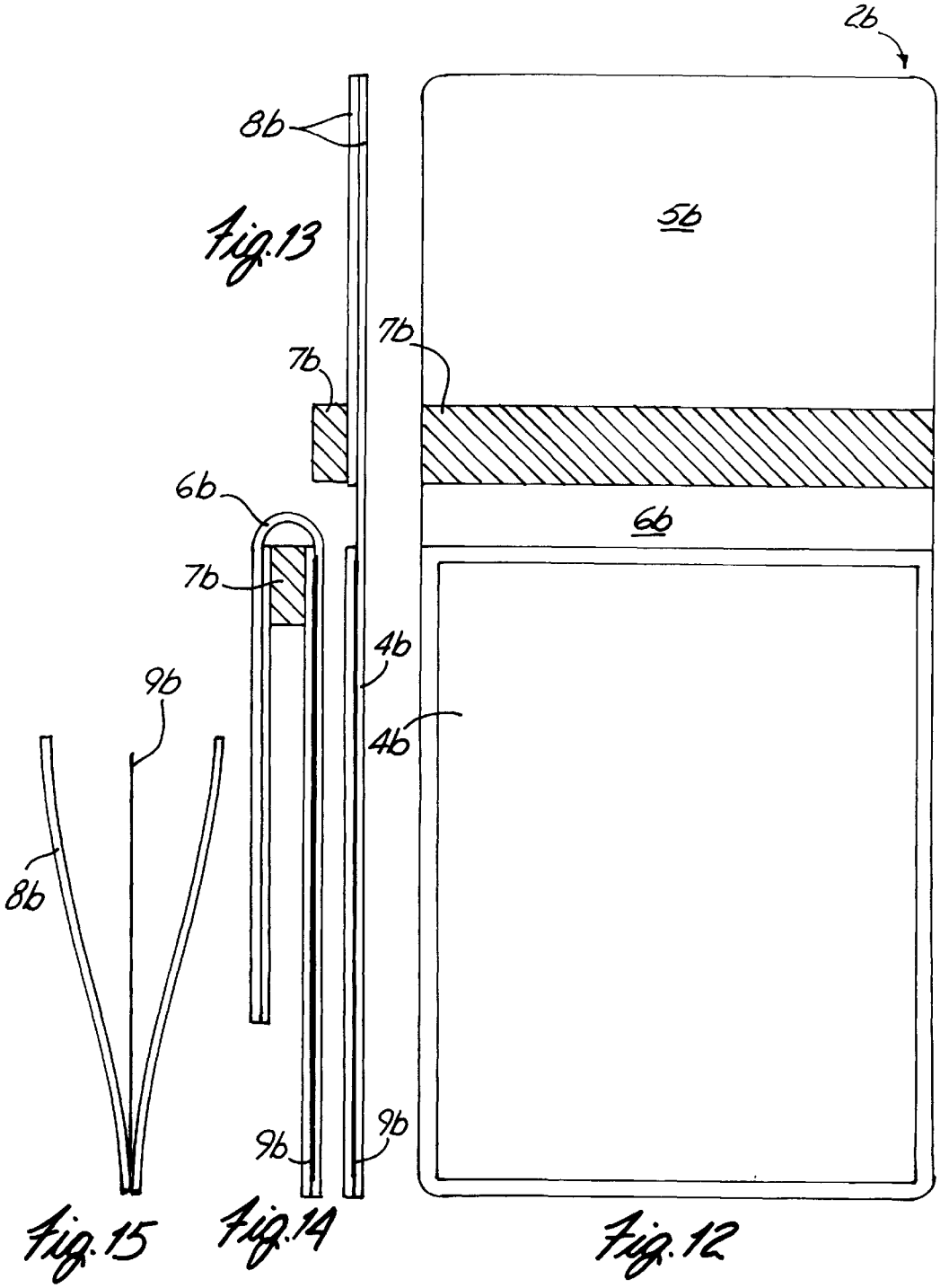
Figure 17:
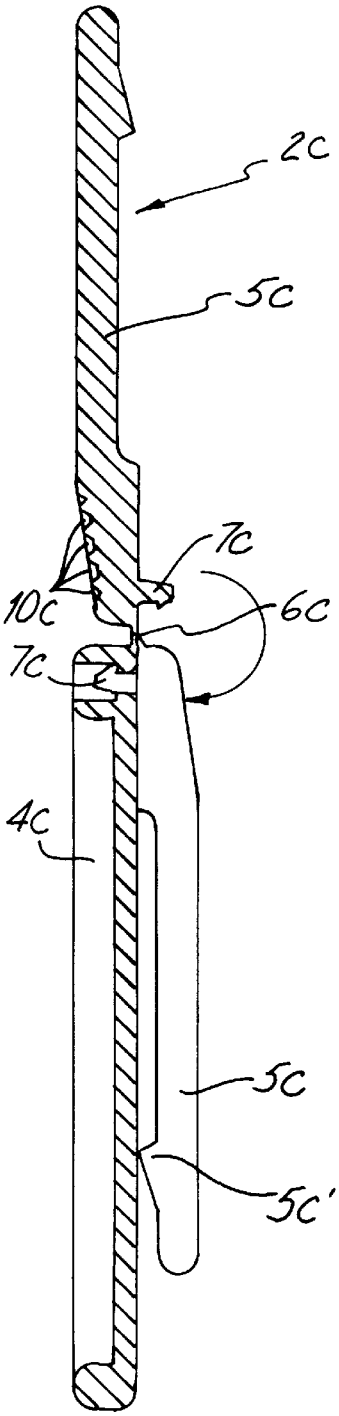
Figure 16:
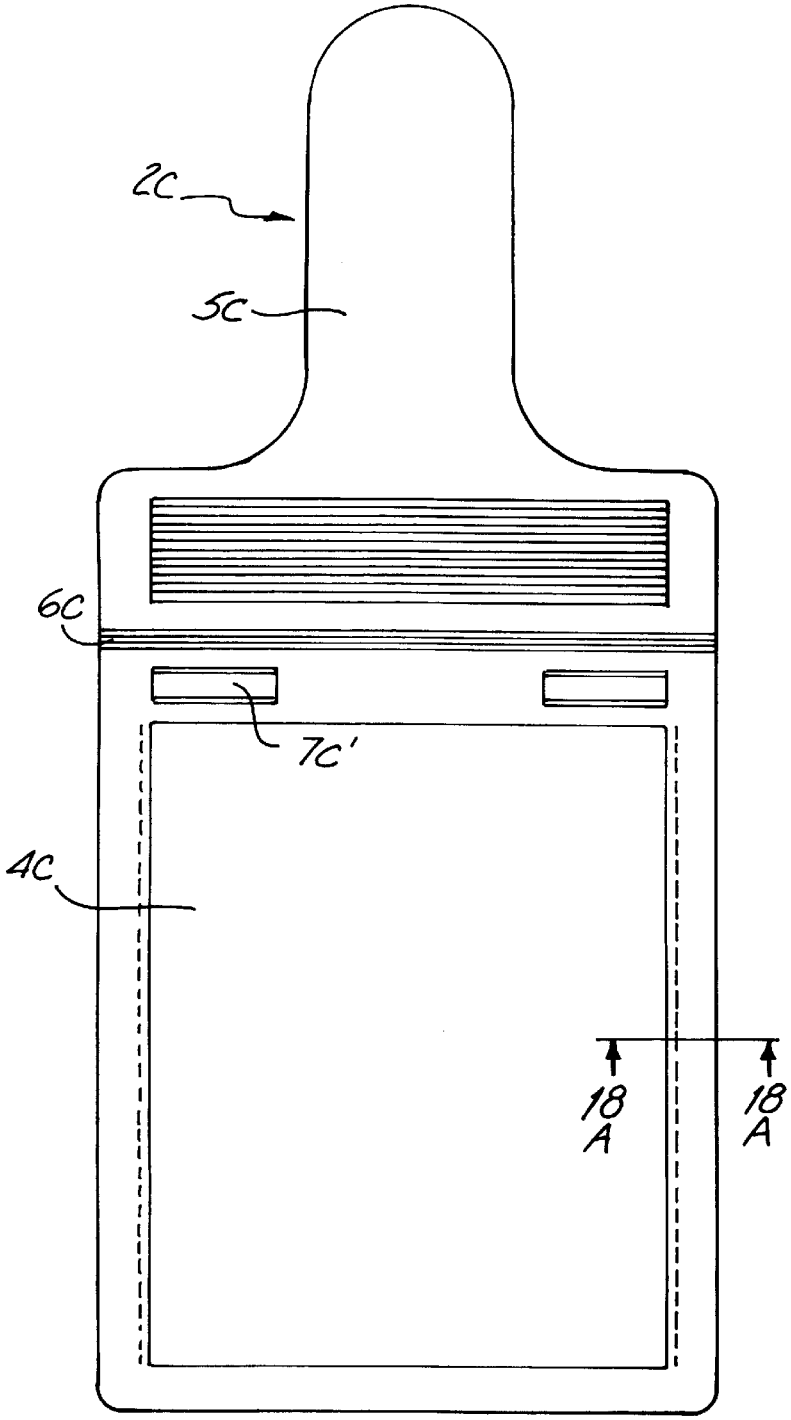
Figure 18:
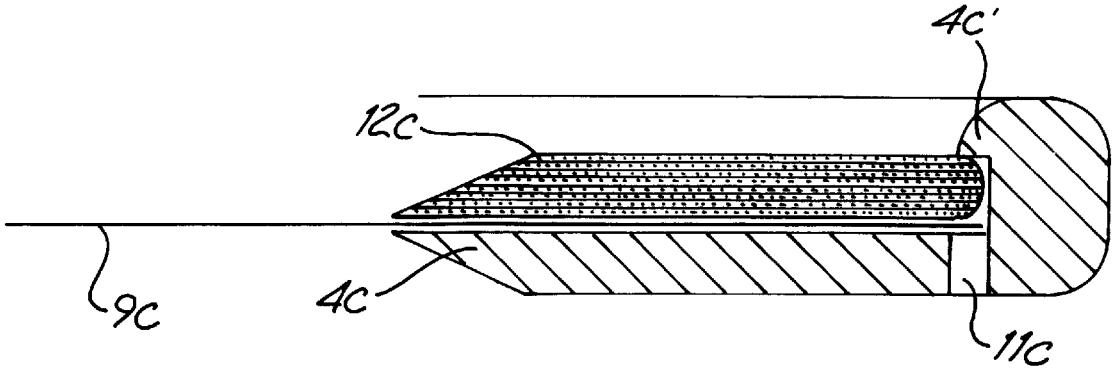
Figures 19, 20, 21:
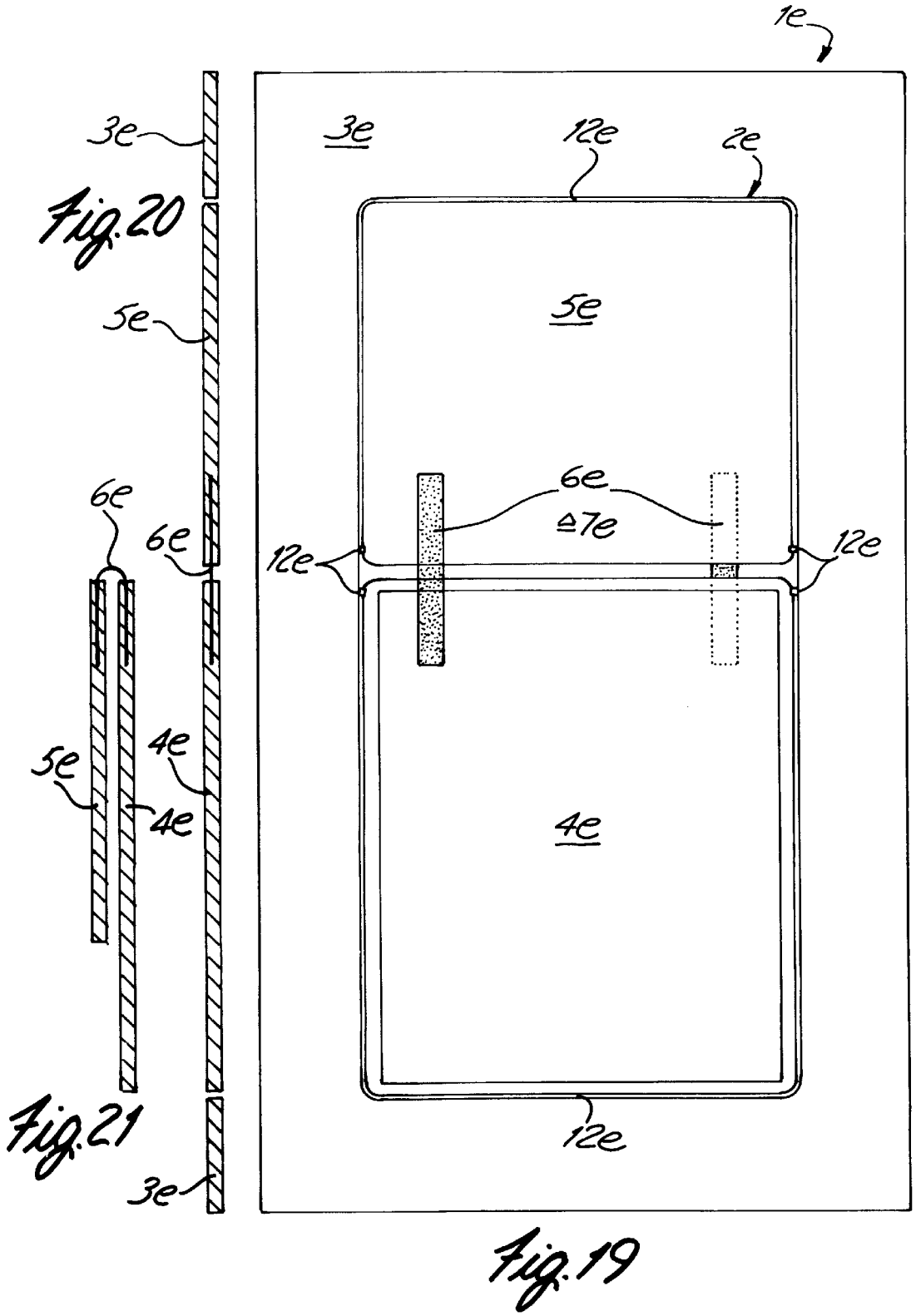
Figures 22, 23, 24, 25:
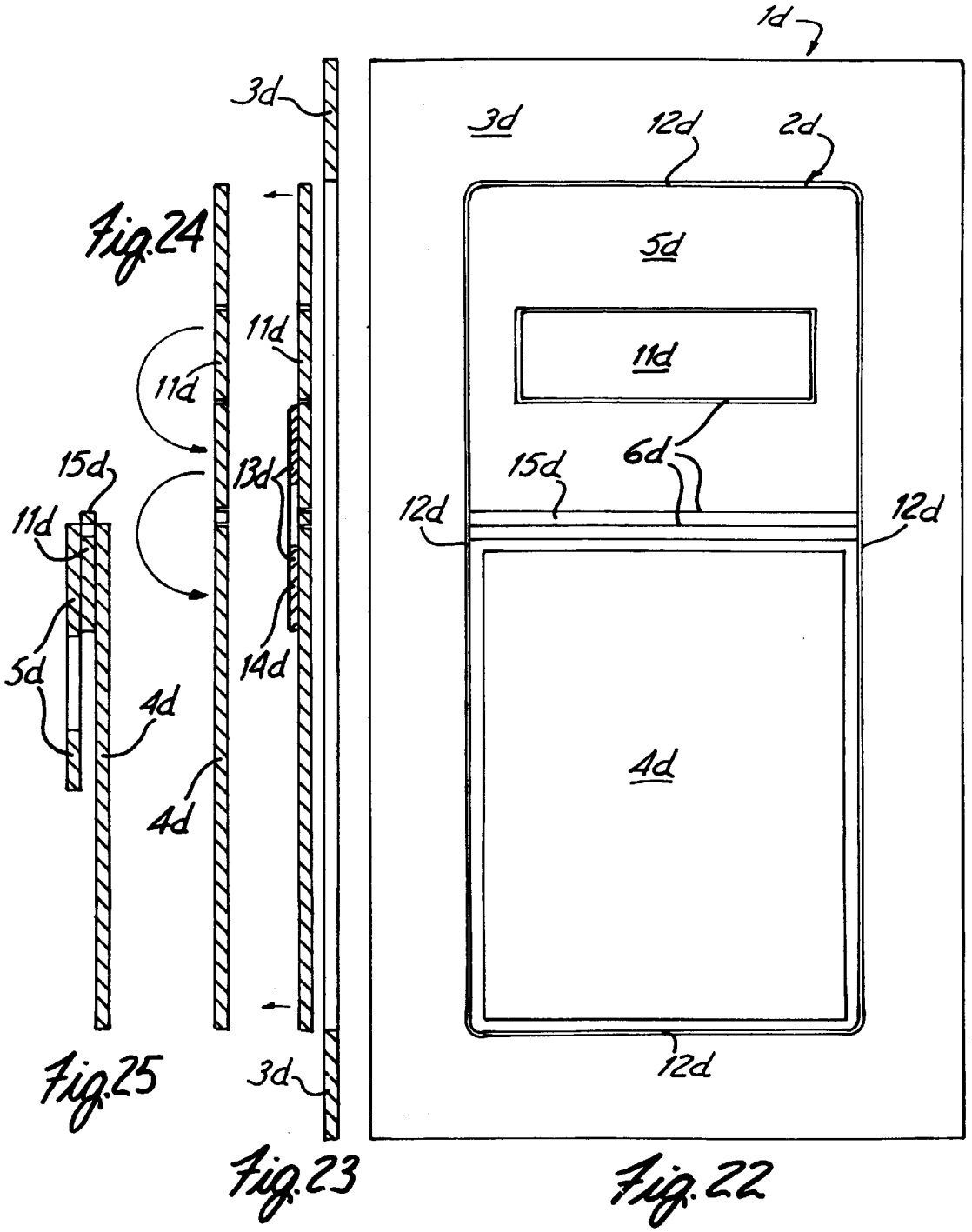

FIG. 1 shows a front view of a first embodiment of a proof-of-entry device of the present invention, FIG. 2 shows a side view of the proof-of-entry device of the present invention according to FIG. 1, FIG. 3 shows a back view of a second embodiment of the proof-of-entry device of the present invention, FIG. 4 shows a side view of the proof-of-entry device according to FIG. 3, FIG. 5 shows a back view of a third embodiment of the proof-of-entry device of the present invention, FIG. 6 shows a side view of the proof-of-entry device according to FIG. 5, FIG. 7 shows a detailed back view of the badge of the proof-of-entry device according to FIG. 1, FIG. 8 shows a front view of the badge according to FIG. 7, FIG. 9 shows a partial section along B—B in FIG. 8, FIG. 10 shows a detail of the badge according to FIG. 9, FIG. 11 shows a spring element for a badge according to FIG. 9, FIG. 12 shows a back view of a first embodiment of a badge of the present invention, in particular for the proof-of-entry device of the present invention, FIG. 13 shows a side view of the badge according to FIG. 12 in the unfolded position, FIG. 14 shows a side view of the badge according to FIG. 12 in the folded position, FIG. 15 shows a detail of the badge according to FIG. 12 before assembly, FIG. 16 shows a front view of a further embodiment of a badge of the present invention, in particular for the proof-of-entry device of the present invention, FIG. 17 shows a longitudinal section of the badge according to FIG. 16, FIG. 18 shows a detail of a section along A—A of FIG. 16, FIG. 19 shows a front view of a further embodiment of a proof-of-entry device of the present invention with a further badge of the present invention and an invalidation component provided thereon, FIG. 20 shows a longitudinal section of the proof-of-entry device according to FIG. 19, FIG. 21 shows a longitudinal section of the badge according to FIG. 19 in the folded position, FIG. 22 shows a front view of a further embodiment of a proof-of-entry device of the present invention with a further badge of the present invention and an invalidation component provided thereon, FIG. 23 shows a longitudinal section of the proof-of-entry device according to FIG. 22 when the badge has been separated from the invalidation component, FIG. 24 shows a schematic view of the folding of the badge according to FIG. 22 and FIG. 25 shows a longitudinal section of the badge according to FIG. 22 in the folded position.

FIGS. 1 to 6 show proof-of-entry devices 1 according to the present invention with different badges 2 and different invalidation components 3. According to FIGS. 1 and 2, an invalidation component 3*a* is attached to a badge 2*a*, for example on its back. On its front, the badge 2*a* comprises a design (not shown), for example in a pocket provided on the front. This design can for example be a printed or enamelled image showing for example a subject of an exhibit, presentation, performance, event etc. for which the proof-of-entry device was purchased.

The badge 2*a* can be manufactured from a suitable plastic material, cardboard, brass, zinc etc. for example by injection molding, casting or punching. In the front and back views according to FIG. 1, the invalidation component 3*a* preferably covers at least the width and/or length of the badge 2*a*. This way, the proof-of-entry devices are guided by the protruding sides of the invalidation components 3*a* when stacked flatly in a dispenser or a supply of several proof-of-entry devices are connected to each other for example via their invalidation components and can be separated along a perforated line.

The invalidation component 3*a* is preferably a printed cardboard and is attached to the badge 2*a* by means of an adhesive so that it can easily removed from the badge 2*a* prior to or during invalidation without any traces of the adhesive remaining on the badge 2*a*. It is, however, also possible that the invalidation component is formed integrally with the badge in another fashion, for example by means of a perforation, and/or is torn off or punched when the proof-of-entry device is invalidated or it is invalidated by reading the chip, magnetic strip, holographic image or bar code provided on the invalidation component.

Further embodiments of a proof-of-entry device 1*b* or 1*c* according to the present invention are shown in FIGS. 3 and 4 and 5 and 6, respectively. The badges 2*b*, 2*c* shown therein comprise a invalidation component 3*b*, 3*c* on their front sides. Compared to the proof-of-entry device 1*a*, this has the advantage that the proof-of-entry devices 1*b* and 1*c* can be attached to a piece of clothing already before invalidation. This process will be described in more detail later on.

The badges 2*b* and 2*c* are advantageously manufactured straight, i.e. in an unfolded position, and applied to a corresponding invalidation component 3*b* or 3*c*, as shown. This has the great advantage that the badges can easily be manufactured, occupy little space and can therefore be stocked more easily, especially stacked on top of each other. After such proof-of-entry devices have been distributed, they can easily be attached to a piece of clothing together with the corresponding invalidation component by the user. Then the proof-of-entry devices can be invalidated by removal of the invalidation component, for example by the service personnel.

The badges 2*b* and 2*c* comprise designs (not shown) on their front. The invalidation components 3*b* and 3*c* can optically supplement these designs. It is preferred that the invalidation components 3*b*, 3*c* are provided in the shape of a passe-partout surrounding the front side of the badge 2*b*, 2*c*. The window which allows a view of the front side of the badge 2*b*, 2*c* is preferably punched or is made of a transparent film. The film preferably comprises the adhesive by means of which the invalidation component 3*b*, 3*c* is attached to the badge 2*b*, 2*c*.

FIGS. 7 to 10 show a detailed view of the badge 2*a* of the proof-of-entry device 1*a*. According to FIG. 7, a counter-member 5*a* is provided behind a design support 4*a* via a hinge 6*a* comprising a spring 7*a*. As is also shown in FIGS. 9 to 11, the hinge 6*a* comprising a spring 7*a* causes the counter-member 5*a*, for example its convex lower end 5*a*', to be pressed against the back of the design support 4*a*. A free leg above the element 6*a* enables the user to apply pressure and thus move the counter-member 5*a* away from the design support 4*a* against the spring resistance of the spring 7*a* in order to attach the badge 2*a*.

FIGS. 8 and 9 show that the design support 4*a* preferably comprises a front pocket in which a design (not shown) can be firmly attached.

FIGS. 12 to 15 show an embodiment of the badge 2*b* of the present invention which is suitable in particular for the proof-of-entry device of the present invention. A design support 4*b* and a counter-member 5*b* are connected via a hinge 6*b*. The design support 4*b* and the counter-member 5*b* are preferably more rigid or firmer than the hinge 6*b* connecting them.

FIG. 13 shows a preferred embodiment of such a badge 2*b*. The design support 4*b* and the counter-member 5*b* are for example formed by films that are bonded or glued together which imparts them a sufficient degree of rigidity. Such a badge 2*b* can for example have the nature of a check card. The hinge 6*b* on the other hand is preferably formed by only one foil which is why it is elastic and/or plastic enough to be bent relative to the design support 4*b* and the counter-member 5*b*. The rigidity of the design support 4*b* and the counter-member 5*b* is alternatively preferably achieved by rigid plates which are connected by means of a plastic hinge 6*b*, as for example an aluminum foil, an integral hinge or a thin portion.

At a suitable location on the back of the design support 4*b* and/or the counter-member 5*b* a retaining element 7*b* is provided essentially adjacent to the hinge 6*b*. As shown, this retaining element 7*b* preferably has several functions. On the one hand, it can serve as a spacing element between the design support 4*b* and the counter-member 5*b* if the counter-member 5*b* is folded behind the design support 4*b* as shown in FIG. 14. This ensures that there is a space between the design support 4*b* and the counter-member 5*b* so that the badge 2*b* can be attached to a piece of clothing, for example the lapel of a jacket. On the other hand, on the surface exposed in the unfolded position, the retaining element 7*b* comprises for example an adhesive which is e.g. covered with a peelable film in this position. Prior to attaching the badge 2*b*, the peelable film has to be peeled off the retaining element 7*b*, which secures the design support 4*b* and the counter-member 5*b* in the folded position as shown in FIG. 14. The retaining element 7*b* is preferably an elastic material such as for example a polyurethane foam, sponge rubber or a dense foamed material.

FIGS. 13 to 15 show as an example how a design 9*b* can for example be enclosed between two films 8*b* and form a design support 4*b*. In this case, at least the film on the front of the design support 4*b* should be transparent. The films 8*b* are preferably adhesive on their inside surface or bonded at those points where they are directly opposite each other.

It is, however, also conceivable that merely a design 9*b* firmly attached to one film 8*b* imparts the necessary firmness to the design support 4*b*. The counter-member 5*b* is formed by two films 8*b* and the hinge 6*b* is preferably and advantageously formed by one film as shown.

The films 8*b* in the depicted embodiment preferably have a thickness of 0.5 mm. The design 9*b* is preferably a printed cardboard, such as for example Chromolux® of about 120 g.

FIGS. 16 to 18 show a further embodiment of a badge 2*c* of the present invention which shows the principle of an especially suitable badge according to the invention more clearly and which is suitable in particular for the proof-of-entry device of the present invention.

Here as well a design support 4*c* and a counter-member 5*c*, which are both relatively rigid or firm, are connected via a flexible hinge 6*c*. Furthermore, both parts are preferably secured in a folded position by means of a retaining element 7*c*.

In an embodiment where the badge 2*c* is made of a plastic material, the hinge 6*c* is preferably an integral hinge or a thin portion. The design support 4*c* preferably comprises a pocket as can be seen in FIG. 17. Furthermore, the retaining element 7*c*, 7*c*' is preferably provided as an undercut trunnion 7*c* at the counter-member 5*c*, wherein the trunnion 7*c* engages with a corresponding recess 7*c*' when the design support 4*c* and the counter-member 5*c* are folded. Preferably, as is also depicted, several trunnions 7*c* and several recesses 7*c*' are provided. However, other retaining elements securing the design support 4*c* and the counter-member 5*c* in the folded position, such as for example a snap fastener, an adhesive pad and the like, are also conceivable. In the depicted embodiment the trunnion 7*c* shown in FIG. 17 only shows an undercut at the bottom in the unfolded position. Such a design facilitates the engagement of the trunnion 7*c* with the recess 7*c*'. The recess 7*c*' comprises at least one relief which positively engages with the undercut of the trunnion 7*c* in the folded position.

The counter-member 5*c* preferably comprises a serration 10*c* in order to prevent the user's finger from slipping while attaching the badge to his or her clothing. Furthermore, the counter-member 5*c* comprises a convex element 5*c*' in the vicinity of its free end which further improves the fastening of the badge 2*c* to the piece of clothing.

FIG. 18 furthermore shows an advantageous embodiment of the badge 2*c* intended to give the impression of relatively high quality. The design support 4*c* comprises a projecting portion 4*c*' on its sides behind which a transparent plate, for example consisting of 1 mm acrylic glass, is snapped. The design 9*c* can then be provided between the design support 4*c* and the plate 12*c*. Furthermore, as shown in FIG. 18, a slide opening 11*c* is advantageously provided for the production of the design support 4*c* from a plastic material.

FIGS. 19 to 21 show a further embodiment of a proof-of-entry device 1*e* according to the present invention with a further embodiment of a badge 2*e* according to the present invention. In this embodiment, the badge 2*e* and an invalidation component 3*e* are formed integrally. Both elements 2*e*, 3*e* are manufactured together for example from a suitable plastic material. In order to ensure an easy separation of the invalidation component 3*e* from the badge 2*e* short fins 12*e* are provided at some points which have to be severed in order to separate the invalidation component 3*e* from the badge 2*e*. FIG. 19 shows one of many possible arrangements of the fins 12*e* which in the depicted example should in particular ensure that a design support 4*e* and a counter-member 5*e* in the non-invalidated position remain in the invalidation component 3*e* as rigidly as possible.

Alternatively, a perforation can be provided between the badge 2*e* and the invalidation component 3*e*.

As a hinge 6*e*, the depicted example shows permanently flexible elements, preferably two metal strips 6*e*, incorporated in the badge 2*e*, for example by casting or attaching. The metal strips 6*e* ensure that the counter-member 5*e* is permanently flexible relative to the design support 4*e* as is shown in FIG. 21.

FIGS. 22 to 25 show a further embodiment of the proof-of-entry device 1*d* according to the present invention with a further embodiment of a badge 2*d* according to the present invention. The badge 2*d* as well as an invalidation component 3*d* are connected via fins 12*d* and can easily be separated. Preferably, they are formed integrally from the same kind of material. In particular FIG. 23 clearly shows the separation of elements 2*d*, 3*d*.

A counter-member 5*d* can preferably be bent relative to a design support 4*d* by means of integral hinges 6*a* located between them. Furthermore, a window with an intermediate element 11*d* is provided on the counter-member 5*d*, which window is closed in the initial position. The intermediate element 11*d* is flexible relative to the counter-member 5*d* via another preferred integral hinge 6*d*. Preferably, adhesive areas 13*d* are provided on the counter-member 5*d* and the back of the design support 4*d* at suitable locations. In the initial position they are preferably covered by release paper 14*d* which can be peeled off the adhesive areas 13*d* when required, as is shown in FIG. 23. This can be done before or after the badge 2*d* is removed from the invalidation component 3*d*.

FIGS. 24 and 25 show how the intermediate element 11*d* can first be bent to contact the lower part 5*d* of the counter-member, where it adheres due to the upper adhesive area 13*d* which is only depicted in FIG. 23.

Then the entire counter-member 5*d* together with the already bent intermediate element 11*d* is folded onto the back of the design support 4*d*. In order to ensure a parallel arrangement of the counter-member 5*d* and the design support 4*d* with the intermediate element 11*d* inbetween, a spacing element 15*d* is provided which preferably has a width that approximately corresponds to the thickness of the intermediate element 11*d*.

By means of a second adhesive area 13*d*, which is shown in FIG. 23 as the bottom-most area, the surface of the intermediate element 11*d* which is adjacent to the design support 4*d* is permanently adhered to the design support 4*d*. Thus, a free end of the counter-member 5*d* is obtained which is parallel to the design support 4*d* at a distance so that the badge is imparted the form of a clasp.

The invalidation components 3*d*, 3*e* according to FIGS. 19 to 23 preferably carry chips, magnetic strips, holographic images and/or bar codes on their front or back sides. If these elements are provided on the front, they may optionally be incorporated advantageously in the design of the invalidation component 3*d*, 3*e*. Thus, in addition, creative effects can be achieved by means of these functional elements.

All the described preferred elements of the badge of the present invention are interchangeable or can be combined with each other.

Preferably, a stock of proof-of-entry devices comprises several proof-or-entry devices which are stacked flatly on top of each other. Alternatively, a stock preferably comprises several proof-of-entry device detachably connected with each other which are for example wound into a roll.

What is claimed is:

1. A proof-of-entry device for controlling entry to an area, comprising:

a badge having a front badge surface including a badge design visible from the front of the badge, the badge having a back adapted for removable attachment to clothing;

an invalidation component integral with the badge and the invalidation component being adapted for manual severance by service personnel upon entry to the area as proof of entry to the area, the manual severance making the badge invalid for subsequent entry to the area, wherein the proof-of-entry device is a badge, further comprising:

a) a design support formed on the front of the badge surface and adapted to hold the badge design, b) a counter-member adapted to press against the badge back surface for attaching the badge to clothing, c) a hinge connecting the design support and the counter-member for folding the counter-member behind the design support, d) a retaining element which, when the counter-member has been folded behind the design support, substantially secures these components, and e) an integral portion on the badge adapted to be severed to separate an invalidation component from the badge for manually invalidating the badge for subsequent entry.

2. The badge according to claim 1, wherein the design support is formed by at least one foil or film and the counter-member is formed by two foils or films and the hinge is formed by one foil or film.

3. The badge according to claim 1, wherein the retaining element is an adhesive pad.

4. The badge according to claim 1, wherein the design support and the counter-member are made of solid plastic material and are connected by an integral hinge or a thin portion as hinge such that they can be moved back and forth.

5. The badge according to claim 1, wherein the retaining element comprises a trunnion and a recess formed in the counter-member and the design support respectively, or the other way round, wherein the trunnion is engaged in the recess when the badge is folded.

6. The badge according to claim 1, wherein the counter-member and design support are connected by at least one embedded hinge which also forms the retaining element.

7. The badge according to claim 1, wherein the counter-member is spaced behind the design support and can be moved back and forth essentially parallel by means of an intermediate element and a suitable hinge.

8. A device for controlling entry, comprising:

a badge having a design support portion including a front surface adapted to display a design visible from the front of the badge, a design support top border, an integral bendable hinge portion joined to the design support top border, and a countermember portion integrally joined to the hinge;

a retaining element attached to the badge adjacent the hinge and having an adhesive surface;

the badge being foldable at the hinge so that the front surface faces forward and the countermember is folded behind the badge, the adhesive surface holding the badge in place on a wearer's clothing; and an invalidation component integrally formed with the badge and adapted for severance by service personnel upon entry to the area as proof of entry to the area, the severance invalidating the badge for subsequent entry to the area.

9. The device for controlling entry of claim 8, further comprising a piece of peelable film on the adhesive surface.

10. The device for controlling entry of claim 8, wherein the badge and invalidation component are integrally formed of cardboard.

11. The device for controlling entry of claim 8, wherein the badge and invalidation component are joined along a perforation.

12. The device for controlling entry of claim 8, further comprising a transparent film on the front surface.

13. The device for controlling entry of claim 8, further comprising a design displayed on the front surface.

14. The device for controlling entry of claim 13 wherein the design comprises a holographic image.

15. The device for controlling entry of claim 13 wherein the design comprises a bar code.

16. A method of controlling entry of a person to an area, comprising:

providing a badge with a front badge surface with a display of a badge design visible from the front of the badge;

adapting a back badge surface for removable attachment to clothing worn by the person;

integrally forming a invalidation component on the badge which is adapted for manual severance by service personnel upon entry to the area;

manually severing the invalidation component upon entry of the person to the area to make the remaining badge invalid for subsequent entry to the areas;

providing a retaining element attached to the back of the badge, the retaining element having an adhesive surface; and providing a peelable film covering the adhesive surface.

* * * * *